US006402423B1

(12) United States Patent
Stellmach

(10) Patent No.: US 6,402,423 B1
(45) Date of Patent: Jun. 11, 2002

(54) APPARATUS FOR AND METHOD OF PROVISIONALLY COVERING AN INSPECTION SHAFT OF A SUBTERRANEAN DUCT SYSTEM

(76) Inventor: Paul-Gerd Stellmach, Hohe Warth 16, 32052 Herford (DE)

( * ) Notice: Subject to any disclaimer, the term of this patent is extended or adjusted under 35 U.S.C. 154(b) by 0 days.

(21) Appl. No.: 09/476,769

(22) Filed: Jan. 3, 2000

(30) Foreign Application Priority Data

Jan. 12, 1999 (DE) ..... 299 00 250 U

(51) Int. Cl.[7] ..... E02D 29/14
(52) U.S. Cl. ..... 404/26
(58) Field of Search ..... 404/25, 26; 52/19, 52/20; 137/364

(56) References Cited

U.S. PATENT DOCUMENTS

| | | | | | |
|---|---|---|---|---|---|
| 3,629,981 | A | * | 12/1971 | McCarrery | 52/19 |
| 4,075,796 | A | * | 2/1978 | Cuozzo | 52/20 |
| 4,325,405 | A | * | 4/1982 | Christo | 137/371 |
| 4,514,931 | A | * | 5/1985 | Beck et al. | 49/21 |
| 4,548,230 | A | * | 10/1985 | Feit | 137/369 |
| 5,030,030 | A | * | 7/1991 | Simmonds | 404/25 |
| 5,044,822 | A | * | 9/1991 | Moss | 405/52 |
| 5,054,956 | A | * | 10/1991 | Huang | 404/26 |
| 5,564,855 | A | * | 10/1996 | Anderson | 404/26 |
| 5,595,455 | A | * | 1/1997 | Svirklys | 404/25 |
| 5,634,739 | A | * | 6/1997 | Armstrong | 404/26 |
| 6,109,824 | A | * | 8/2000 | Annes | 404/26 |

* cited by examiner

*Primary Examiner*—Gary S. Hartmann
(74) *Attorney, Agent, or Firm*—Henry M. Feiereisen

(57) ABSTRACT

Apparatus for provisionally covering an inspection shaft during surface pavement with asphalt or concrete, includes a cover plate formed with a central breakthrough and a centering device arranged on the bottom side of the cover plate for securing the cover plate in the inspection shaft. A pipe is received in the breakthrough for axial displacement and has an end face for attachment of a flange. The pipe can be closed by a detachable lid. After depositing a first layer of the pavement, the area of the pipe above the lid is cleared manually, and the lid is removed for subsequent elevation of the pipe to a level in which the flange is disposed above the first layer of the pavement. The elevated area of the pipe is backfilled so that the flange can rest upon the first layer before closing the lid and applying a next layer of the pavement.

12 Claims, 3 Drawing Sheets

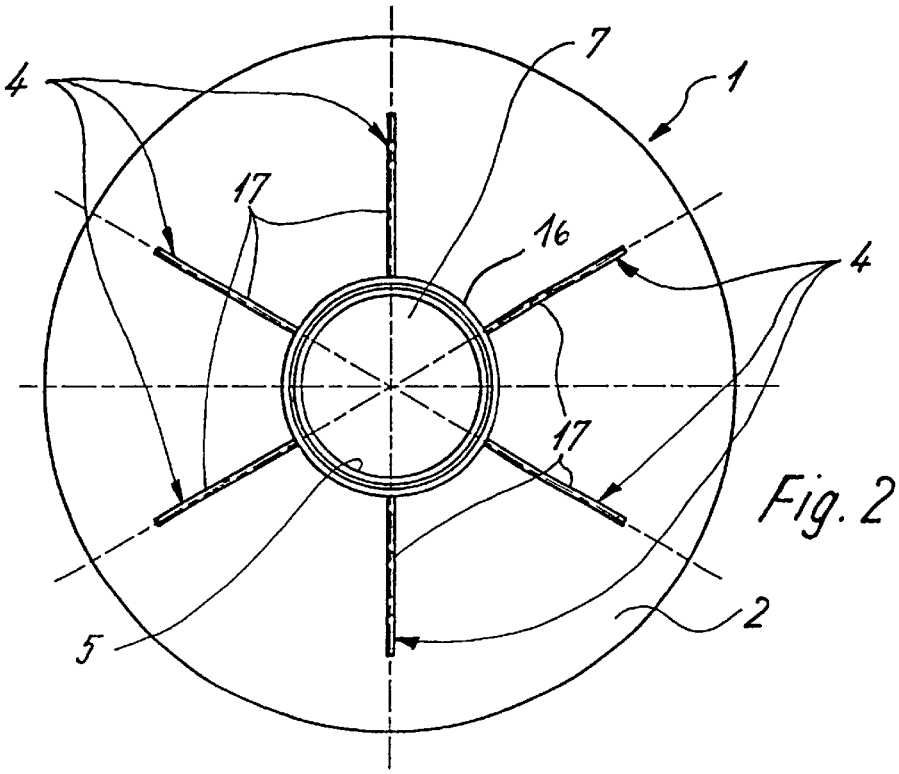
Fig. 2
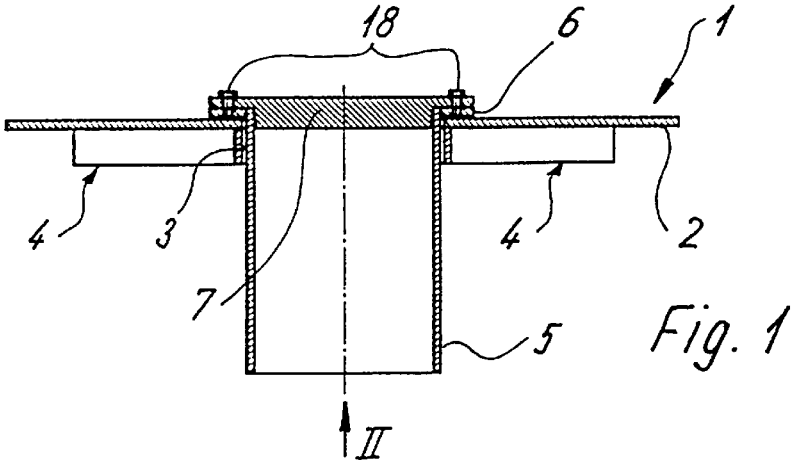
Fig. 1
Fig. 3
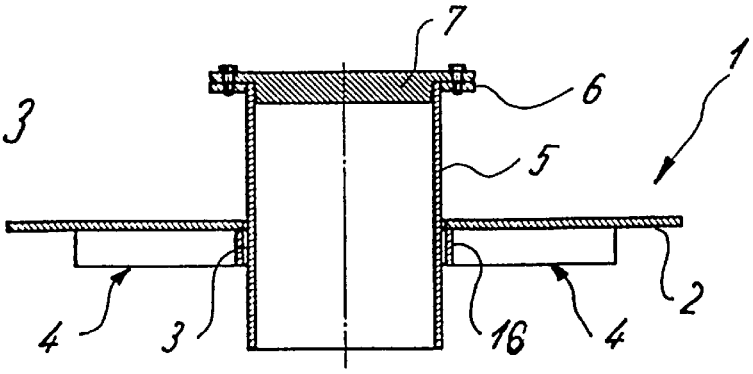

APPARATUS FOR AND METHOD OF PROVISIONALLY COVERING AN INSPECTION SHAFT OF A SUBTERRANEAN DUCT SYSTEM

CROSS-REFERENCES TO RELATED APPLICATIONS

This application claims the priority of German Patent Application Serial No. 299 00 250.0, filed Jan. 12, 1999, the subject matter of which is incorporated herein by reference.

BACKGROUND OF THE INVENTION

The present invention relates to an apparatus for and method of provisionally covering an inspection shaft of an underground duct system during pavement of a surface of a road or square.

Inspection shafts of a subterranean duct system are oftentimes encountered in the area of a surface of a road or square, to be paved with asphalt or concrete. In these situations, the manhole frame including the attached manhole cover are removed from the inspection shaft and the exposed inspection shaft is provisionally covered, before the surface is paved. After removal of the manhole frame and the manhole cover, the upper rim of the inspection shaft is substantially flush with the level of dumped soil on which the asphalt or concrete is laid. The provisional cover prevents soil, asphalt or concrete from dropping into the inspection shaft while yet permitting travel of road-construction vehicles, in particular rollers for compacting the asphalt, concrete or the like, over the inspection shaft.

After pavement of the surface, the rim of the inspection shaft must be cleared again to permit subsequent placement of the manhole frame onto the inspection shaft and connection thereof with the asphalt, concrete or the like, as well as with the rim or, optionally, with a compensation ring, mounted to the inspection shaft for compensating height differences.

Heretofore, the inspection shaft has been provisionally covered during asphalting and concreting by a closed solid plate which has a base area roughly corresponding to the base area of the inspection shaft. During asphalting or concreting, provisions were made to continuously mark the spot of the plate and of the inspection shaft underneath the plate. In this manner, once the surface is fully paved, the plate and the inspection shaft can be cleared again to attach the manhole frame and the manhole cover.

The required marking of the spots of the plate during pavement is very time-consuming and tedious because the provisional marking fails to inform the worker as to the exact location of the center or the edge region of the plate and thus of the inspection shaft. Thus, the fully paved surface must therefore be cleared from asphalt or concrete by hand piece-by-piece in a laborious manner until the edge area of the plate and thus of the inspection shaft becomes visible.

SUMMARY OF THE INVENTION

It is thus an object of the present invention to provide an improved apparatus and method for covering an inspection shaft during pavement of a surface of a road or square, obviating the afore-stated drawbacks.

In particular, it is an object of the present invention to provide an improved apparatus and method for realizing a trouble-free application of asphalt or concrete over a covered inspection shaft while still allowing easy determination of the precise location of the inspection shaft after the surface has been fully paved.

These objects, and others which will become apparent hereinafter, are attained in accordance with the present invention by an apparatus which includes a cover plate formed with a central breakthrough for receiving a pipe for axial displacement therein and including a centering device secured to a bottom side of the cover plate, with the pipe having a centering device distal end face for attachment of a flange, and by providing a detachable lid for closing the pipe.

Through the provision of an apparatus in accordance with the present invention, an inspection shaft can be provisionally covered during asphalting or concreting of a road surface in a cost-saving and time-saving by carrying out the following method steps: Before commencing the actual asphalting or concreting, the cover plate is placed over the inspection shaft and secured by the centering device against lateral displacement relative to the inspection shaft. The pipe is closed by the lid and so inserted in the breakthrough of the cover plate that the flange rests directly on the cover plate. After applying a first layer of asphalt or concrete, the region of the pipe including its flange is easily recognizable by the workman and can be cleared by hand for subsequent removal of the lid. The pipe is then elevated to such an extent that the flange is located above the level of the asphalt course already laid on the surface. In this position, the elevated zone of the pipe and the flange is backfilled with soil, concrete, asphalt or the like so that the flange can be positioned at a level with and supported on the laid course of asphalt or concrete. Thereafter, the pipe is closed again by the lid, which is detachably mounted to the flange, and ready for subsequent application of further layers of asphalt or concrete in a same manner, as described, i.e. after application of each layer, the pipe is elevated accordingly.

In other words, the pipe "grows" with the thickness of the asphalt or concrete applied and, after applying one layer, can easily be leveled with the layer so as to be easily accessible. This is certainly true also with respect to the top layer of the asphalt or concrete so that the cover plate underneath the finished pavement can be easily and precisely located. Clearing of the cover plate and exposing of the inspection shaft can be rapidly carried out, without tedious search for the boundary of the cover plate as the location of the pipe with its flange and lid can easily be ascertained after application of each layer of the pavement. As only one layer of asphalt or concrete is laid at any time upon the pipe when paving the surface with several courses and the pipe grows with each additional layer, the area of the asphalt or concrete above the lid can be cleared rapidly and easily by a drill as the drill can be centered to the disposition of the pipe. However, even a manual clearance of the cover plate is easy to execute without time-consuming search of the precise location, because the center of the pipe can be utilized as reference point for the area of the cover plate to be cleared.

Suitably, the cover plate, pipe, the flange and lid are each made of metal, such as steel or light metal of sufficient strength and heat-resistant properties.

Elevation of the pipe in concert with each laid asphalt layer is realized by a lifting device which is insertable through the pipe, whereby the pipe has a clear diameter which is so sized as to allow passage of a lifting device through the pipe.

According to another feature of the present invention, the centering device of the cover plate includes several ribs diverging from the breakthrough in star-shaped configuration.

The apparatus for provisionally covering an inspection shaft during asphalting or concreting a road or square, in accordance with the present invention, significantly reduces the time required for the clearance of the inspection shaft, because the top of the pipe as well as the lid can quickly be established so that the location of the cover plate and its center beneath the completed pavement can be precisely ascertained.

BRIEF DESCRIPTION OF THE DRAWING

The above and other objects, features and advantages of the present invention will be more readily apparent upon reading the following description of a preferred exemplified embodiment of the invention with reference to the accompanying drawing, in which:

FIG. 1 is a sectional view of an apparatus for provisional covering an inspection shaft in accordance with the present invention, with the apparatus occupying a base position;

FIG. 2 is a bottom view of the apparatus in direction of arrow II in FIG. 1;

FIG. 3 is a sectional view of the apparatus of FIG. 1 in a possible end position;

DETAILED DESCRIPTION OF PREFERRED EMBODIMENTS

Figure 4:
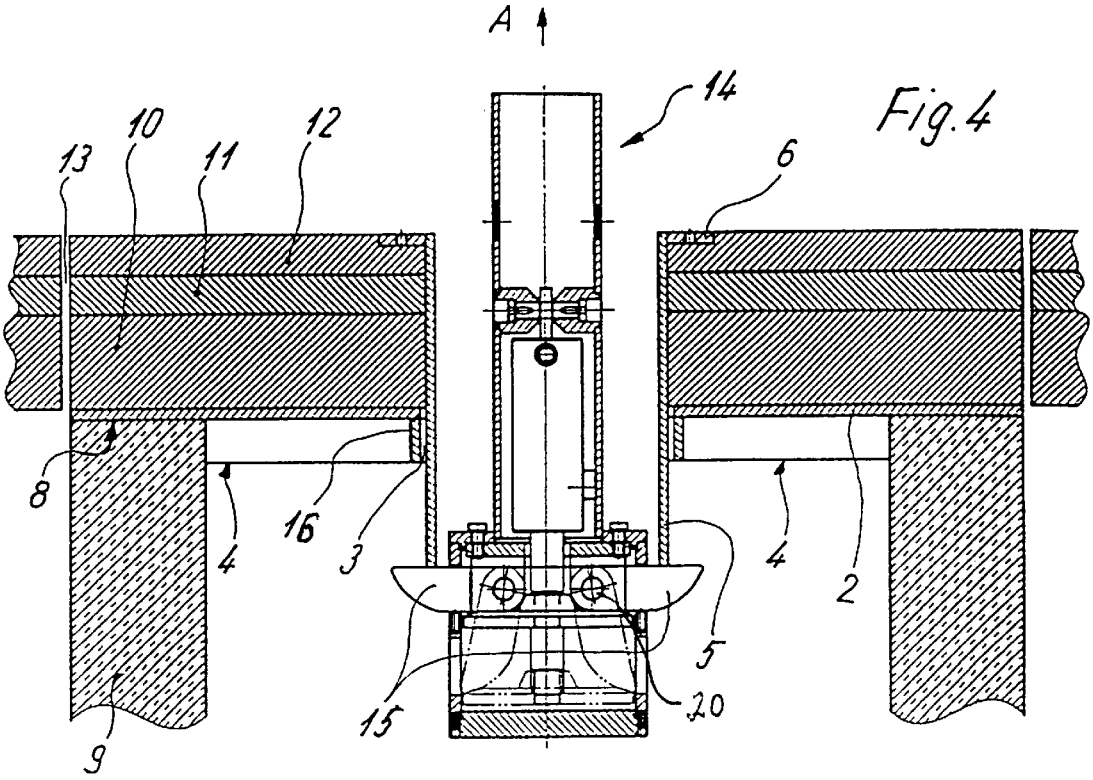
FIG. 4 is a sectional view of the area of the inspection shaft with attached apparatus of FIG. 1 for covering the inspection shaft after finishing pavement of a road surface.

Throughout all the Figures, same or corresponding elements are generally indicated by same reference numerals.

Turning now to the drawing, and in particular to FIG. 1, there is shown a sectional view of an apparatus for provisional covering an inspection shaft during asphalting a road surface or concreting a square, embodying the present invention and generally designated by reference numeral 1. The apparatus 1 includes a cover plate 2 which is formed with a central breakthrough 3. The cover plate 2 has a bottom side for attachment of a guide ring 16 which demarcates the breakthrough 3. Further attached to the bottom side is a centering device, generally designated by reference numeral 4 and including a plurality of ribs 17 extending from the guide ring 16 outwards in a star-shaped configuration, as shown in particular in FIG. 2. The ribs 17 are securely fixed to the bottom side of the cover plate 2 and provide an additional reinforcement of the cover plate 2. Received in the breakthrough 3 for axial displacement is a pipe 5 which has a centering device distal end face formed with a flange 6. A lid 7 can be detachably mounted by screw fasteners 18 to the flange 6 for closing of the pipe 5. Instead of screw fasteners 18, it may be sufficient to secure the lid 7 to the flange 6 of the pipe 5 by simple pins.

Suitably, the support plate 2 as well as the pipe 5, the flange 6 and the lid 7 can be made of metal, such as steel or light metal of sufficient strength and heat-resistant properties.

Figure 5:
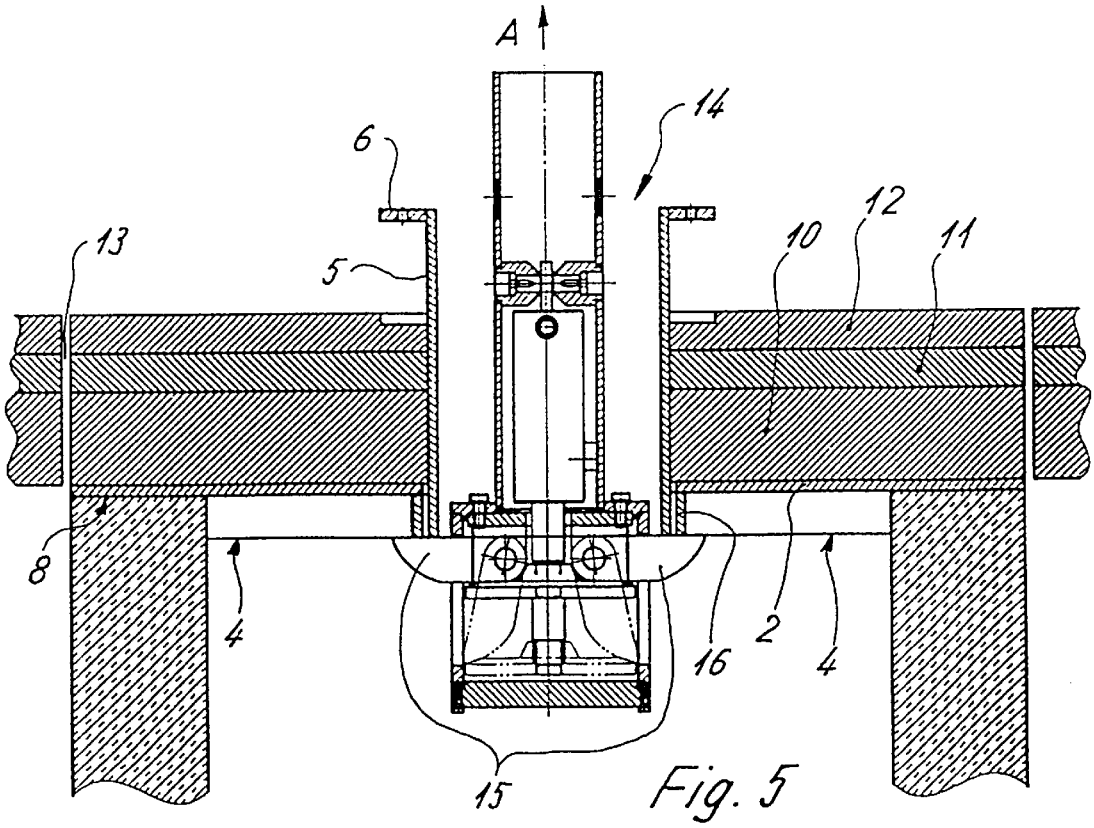
FIG. 5 is a sectional view of the area of the inspection shaft with attached apparatus of FIG. 1 in partially elevated disposition through operation of a lifting device.
Figure 6:
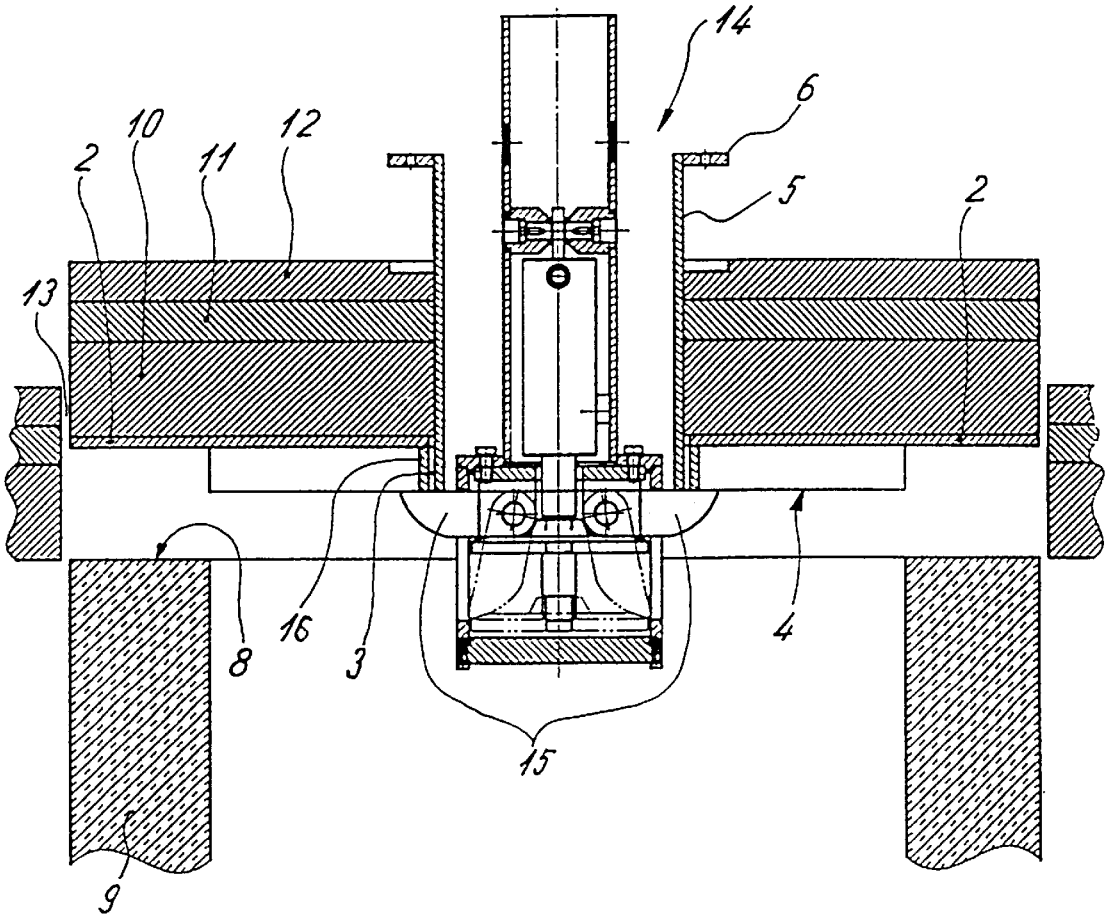
FIG. 6 is a sectional view of the area of the inspection shaft with attached apparatus of FIG. 1, showing in detail removal of the fully paved asphalted area above the inspection shaft through further elevation of the apparatus by the lifting device.

The operation of the apparatus 1 for covering an inspection shaft 9 during asphalting or concreting of a surface will now be described with reference to FIGS. 4 to 6 which indicate the inspection shaft 9 only schematically and illustrate, by way of example, the application of three layers of asphalt 10, 11, 12 for pavement of a road surface. At the start of asphalting, the apparatus I is placed upon an upper support rim 8 of the inspection shaft 9, whereby the flange 5 of the pipe 6 rests directly on the top side of the cover plate 2, as shown in FIG. 1, and the pipe 5 is closed by the lid 7. The ribs 17 of the centering device 4 extend inside the inspection shaft 9 to ensure a proper positioning of the cover plate 2. A displacement of the cover plate 2 relative to the inspection shaft 9 is thereby prevented even when lateral forces are applied during travel of machinery, rollers or the like over the covered inspection shaft 9.

After applying the first asphalt layer 10, the location of the lid 7 of the pipe 5 can easily be ascertained for subsequent clearing the area above the lid 7 by using e.g. a shovel to remove the asphalt layer 10. The lid 7 is then detached and a lifting device, generally designated by reference numeral 14 is inserted through the open pipe 5. The lifting device 14 may run hydraulically or pneumatically and is provided near its lower extremity with engagement members 15 which are each swingable about a pivot axis 20. During passage of the lifting device 14 through the pipe 5, the engagement members 20 are turned inwardly, as shown in dash-dot lines in FIGS. 4 to 6, and, after insertion of the lifting device 14, are pivoted outwards so as to occupy a disposition for abutment against the lower extremity of the pipe 5, as shown in continuous lines in FIGS. 4 to 6.

After detachment of the lid 7, the pipe 5 is elevated by the lifting device 14 to a level with the asphalt layer 10. The region previously occupied by the flange 6 is filled with asphalt, i.e. the elevated pipe 5 is backfilled, so that the flange 6 now rests on the top surface of the first asphalt layer 10. The pipe 5 is closed again by the lid 7 and the next asphalt layer 11 is applied. FIG. 3 shows, by way of example, a possible end position of the pipe 5 in this phase, without illustration of asphalt layers. After laying the second asphalt layer 11, the lid 7 is then cleared again, detached from the pipe 5, and the pipe 5 is further elevated to a level above the layer 11 and backfilled again so as to sit against the asphalt layer 11. The cycle is then repeated for application of the third asphalt layer 12, i.e. the pipe 5 is closed by the lid 7 and the asphalt layer 12 is laid. After clearing the lid 7, the pipe 5 is elevated to the level with the asphalt layer 12 and secured at this level by backfilling with asphalt, as shown in FIG. 4. Subsequently the lid 7 is attached for closing the pipe 5. Asphalting of the road surface is now concluded, whereby the location of the flange 6 and the attached lid 7 can easily be ascertained within the top layer 12 of the pavement.

Clearing of the inspection shaft 9 for attachment of the manhole frame (not shown) with manhole cover (not shown) can be executed, for example by a drill bit which can easily be centered with respect to the visible lid 7. A cut 13 is made in the pavement around the area of the inspection shaft 9 so as to separate the entire pavement above the cover plate 2. Persons skilled in the art will understand that instead of a drill bit, the use of a chisel or other tool is certainly possible to provide the cut 13. The lifting device 14 is actuated to move the apparatus I in the direction of arrow A via the engagement members 5 which bear against the lower extremity of the pipe 5, as shown in FIG. 4. After a certain travel path, the engagement member 15 impact the guide ring 16 at the bottom side of the cover plate 2, as shown in FIG. 5, so that the lifting device 14 can now elevate the cover plate 2 as well as the asphalt layers 10, 11, 12 to thereby completely expose the support rim 8 of the inspection shaft 9. This situation is shown in FIG. 6.

Persons skilled in the art will understand that the elevation of the apparatus 1 including the asphalt layers 10, 11, 12 can certainly be carried out by means other than the shown lifting device, without departing from the spirit of the present invention. Any device which, after separating the pavement above the cover plate 2 by means of a cut 13, can be inserted through the pipe 5 for grabbing the pipe 5 from underneath and for lifting the apparatus 1 with the supported asphalt layers 10, 11, 12 is suitable in accordance with the present invention.

The pipe 5 has a length which is so selected that a centering thereof is ensured in the breakthrough 3 of the cover plate 2 even when the uppermost level of the pavement is reached. Thus, the effective length of the pipe 5 is greater than the entire thickness of the pavement being laid, including the thickness of the cover plate 2. A tilting of the pipe 5 in the area of the breakthrough of the cover plate 2 is prevented by the guide ring 16 which is in concentric relationship to the breakthrough 3.

The foregoing description sets forth that the support rim 8 of the inspection shaft 9 for placement of the apparatus I is at a level for immediate application of the asphalt or concrete. However, it is certainly within the scope of the present invention, to dump other layers of construction material before applying the actual asphalt or concrete, without departing from the spirit of the present invention. For example, it is certainly conceivable to initially deposit a ballast layer over the covered inspection shaft 9 before dumping asphalt. Also in this case, after applying the ballast layer, the pipe 5 is cleared, the lid 7 is detached and the pipe 5 is elevated to a level of the ballast layer so that, after backfilling, the flange 6 of the pipe 5 rests on top of the ballast layer. After closing the pipe 5 with the lid 7, the inspection shaft 9 is completely sealed off, and asphalt can be dumped thereon.

While the invention has been illustrated and described as embodied in an apparatus for and method of provisionally covering an inspection shaft of a subterranean duct system, it is not intended to be limited to the details shown since various modifications and structural changes may be made without departing in any way from the spirit of the present invention.

What is claimed as new and desired to be protected by Letters Patent is set forth in the appended claims:

1. Apparatus for provisionally covering an inspection shaft during pavement of a surface with asphalt or concrete, comprising:

a cover plate formed with a central breakthrough spaced from a peripheral area of the cover plate at a distance sufficient to allow compacting of a pavement layer in the peripheral area of the cover plate, said cover plate having a bottom side provided with centering means for securing the cover plate against displacement in a horizontal direction;

a pipe received in the breakthrough for axial displacement and having an end face distal to the centering means;

a flange connected to said end face of the pipe; and a detachable lid for closing the pipe and providing a reference for ascertaining an outline of the cover plate, wherein the centering means of the cover plate includes several ribs diverging outwardly from the breakthrough in star-shaped configuration.

2. The apparatus of claim 1 wherein the cover plate is made of metal.

3. The apparatus of claim 1 to wherein the pipe and the flange are each made of metal.

4. The apparatus of claim 1 wherein the lid is made of metal.

5. The apparatus of claim 1 wherein the pipe has a length which is greater than a width of the pavement including a total width of the cover plate.

6. The apparatus of claim 1 wherein the lid is detachably mounted to the flange of the pipe.

7. The apparatus of claim 1 wherein the pipe has a clear diameter which is so sized as to allow passage of a lifting device through the pipe.

8. The apparatus of claim 1 wherein the cover plate has a base surface which is greater than a base surface of an inspection shaft to be covered.

9. The apparatus of claim 1 wherein the cover plate is provided with a guide ring mounted in concentric relation to the breakthrough of the cover plate.

10. A method of provisionally covering an inspection shaft during pavement of a surface with asphalt or concrete; comprising the steps of:

a) attaching a cover plate to an inspection shaft such that the cover plate covers the inspection shaft while secured against displacement in a horizontal direction;

b) inserting into the inspection shaft through a breakthrough in the cover plate a pipe having a upper flange and positioned at a distance sufficient to allow compacting of a pavement layer in a peripheral area of the cover plate;

c) closing the open top by a lid to seal access to the inspection shaft and to provide a reference for ascertaining an outline of the cover plate;

d) clearing the area of the pipe above the lid after a first layer of the pavement is laid;

e) removing the lid from the pipe;

f) elevating the pipe to a level above the first layer of the pavement;

g) backfilling an area underneath the flange for permitting the flange to rest on the first layer before closing the open top and laying a next layer of the pavement;

h) repeating steps c), d) e) f) and g), when necessary, to complete the surface pavement; and i) withdrawing the cover plate and the pipe from the inspection shaft.

11. Apparatus for provisionally covering an inspection shaft of a subterranean duct system during pavement of a surface with asphalt or concrete, comprising:

a cover plate configured for masking an inspection shaft;

a pipe displaceably received in a breakthrough of the cover plate at a distance sufficient to allow compacting of a pavement layer in a peripheral area of the cover plate, said pipe including a flange projecting outwardly from an open end face;

a lid detachably mounted to the pipe for closing the end face of the pipe and providing a reference for ascertaining an outline of the cover plate; and a lifting device insertable through the pipe for elevating the pipe after each application of a layer of pavement so as to position the flange before application of a next layer on top of a preceding one of the layers and to withdraw the apparatus from the inspection shaft after conclusion of the surface pavement, wherein the cover plate has a bottom side formed with several ribs diverging outwardly from the breakthrough in star-shaped configuration for securing the cover plate with respect to the inspection shaft against displacement in a horizontal direction.

12. The apparatus of claim 11 wherein the cover plate is provided with a guide ring mounted in concentric relation to the breakthrough of the cover plate for realizing a proper positioning of the pipe.

* * * * *